US009951759B2

(12) United States Patent
Van Swieten et al.

(10) Patent No.: US 9,951,759 B2
(45) Date of Patent: Apr. 24, 2018

(54) PUMPING DEVICE FOR A FLUID CONTAINER

(75) Inventors: Roy Van Swieten, Hedel (NL); Johannes Hubertus Jozef Maria Kelders, Vlijmen (NL)

(73) Assignee: Airopack Technology Group AG, Baar (CH)

( * ) Notice: Subject to any disclaimer, the term of this patent is extended or adjusted under 35 U.S.C. 154(b) by 0 days.

(21) Appl. No.: 14/124,593

(22) PCT Filed: Jun. 8, 2012

(86) PCT No.: PCT/IB2012/052909

§ 371 (c)(1),
(2), (4) Date: Jan. 16, 2014

(87) PCT Pub. No.: WO2012/168916

PCT Pub. Date: Dec. 13, 2012

(65) Prior Publication Data

US 2014/0183229 A1 Jul. 3, 2014

(30) Foreign Application Priority Data

Jun. 9, 2011 (CH) ..... 1603/11

(51) Int. Cl.
*B05B 11/00* (2006.01)
*F04B 23/02* (2006.01)

(52) U.S. Cl.
CPC ..... *F04B 23/028* (2013.01); *B05B 11/0048* (2013.01); *B05B 11/3033* (2013.01); *B05B 11/3076* (2013.01); *B05B 11/3097* (2013.01)

(58) Field of Classification Search
CPC ..... B05B 11/3035; B05B 11/3076; B05B 11/0048; B05B 11/3033; B05B 11/3097; F04B 23/028

(Continued)

(56) References Cited

U.S. PATENT DOCUMENTS 4,347,953 A * 9/1982 Bauer ..... B05B 1/083 222/207
4,452,379 A * 6/1984 Bundschuh ..... B05B 11/007 222/207

(Continued)

FOREIGN PATENT DOCUMENTS

DE 8713891 U1 2/1989

*Primary Examiner* — Charles P Cheyney
(74) *Attorney, Agent, or Firm* — Seed IP Law Group LLP

(57) ABSTRACT

A novel pumping device (1) with an actuator (4) and a head part (5) for dispensing a fluid from a container (2) is described. The actuator (4) comprises an outlet conduit (37) and a first cylindrical member (18) and the head part (5) comprises a second cylindrical member (20) which is arranged coaxially to the first cylindrical member. A folded membrane member (22) with an inlet valve (24) and an outlet valve (25) is provided between the first (18) and second (20) cylindrical members, such that the first (18) and second (20) cylindrical members and the folded membrane member (22) provide a variable pump chamber (27). The outlet valve (25) is arranged relative to the actuator (4) in such a manner that a suck-back chamber (38) with a variable volume is provided between the outlet valve (25) and the outlet conduit (37), which is simultaneously reduced as the pumping chamber (27) is reduced.

13 Claims, 3 Drawing Sheets

(58) Field of Classification Search
USPC ..... 222/207, 321.7, 321.9, 386, 341, 494
See application file for complete search history.

(56) References Cited

U.S. PATENT DOCUMENTS 4,767,032 A * 8/1988 Smith ..... B65D 83/0022 222/319
4,979,646 A * 12/1990 Andris ..... 222/136
5,014,881 A * 5/1991 Andris ..... 222/207
5,238,156 A * 8/1993 Andris ..... B05B 11/007 222/207
5,267,673 A 12/1993 Crosnier et al.
5,544,789 A * 8/1996 Gillingham ..... 222/153.13
5,687,884 A * 11/1997 Bodin et al. ..... 222/321.7
5,704,519 A * 1/1998 Crosnier et al. ..... 222/207
5,788,124 A * 8/1998 Bougamont et al. ..... 222/207
5,819,990 A 10/1998 Cimentepe et al.
6,202,896 B1 * 3/2001 Bonningue ..... B05B 11/3001 222/207
6,227,414 B1 5/2001 Peronnet et al.
6,279,785 B1 * 8/2001 Bonningue ..... B05B 11/3001 222/321.7
6,776,309 B2 * 8/2004 Schultz ..... B05B 1/3436 222/321.1
7,793,803 B2 * 9/2010 Neerincx et al. ..... 222/207
9,096,362 B2 * 8/2015 Von Schuckmann ..... B05B 11/0013
2006/0196889 A1 * 9/2006 Masuda ..... B05B 11/0051 222/256
2006/0255071 A1 * 11/2006 Behar et al. ..... 222/256
2008/0110934 A1 5/2008 Behar
2009/0110576 A1 * 4/2009 Brouwer ..... B05B 11/3033 417/472
2010/0102090 A1 4/2010 Hummel
2010/0116849 A1 5/2010 Lautre
2010/0294805 A1 11/2010 Pohlmann et al.

* cited by examiner

PUMPING DEVICE FOR A FLUID CONTAINER

REFERENCE TO RELATED APPLICATIONS

This application is the U.S. national phase entry of International Patent Application no. PCT/IB2012/052909, filed Jun. 8, 2012, which claims priority to Swiss patent application no. 01603/11, flied Jun. 9, 2011.

FIELD OF THE INVENTION

The invention is related to a pumping device for a fluid container.

BACKGROUND OF THE INVENTION

Pumping devices for fluid containers are in general provided with an actuator and a head part connected to the fluid container. Between the actuator and the head part a coil spring is provided in order to repel the actuator from the head part. As the actuator is pushed downwards, an outlet valve in the actuator is opened and fluid is dispensed through an orifice or a spray nozzle. When the actuator is released it will return to its starting position and simultaneously an inlet valve at the head part will be opened and fluid in the container will be sucked into the pump chamber between the actuator and the head part.

These known pumping devices have many different parts with a complicated structure and therefore they are tedious to manufacture. Further the coil spring is normally made of spring steel which has to be protected from the liquid in the container. Another drawback is that the different parts of the pump devices have to be assembled manually.

U.S. Pat. No. 6,227,414 B1 describes for instance a dispensing device for liquid with a support in an opening of a receptacle which encloses the product to be dispensed. The support has a central tubular conduit, a pushbutton axially slidably mounted on the support between a rest position and an active position and a product outlet conduit. An intermediate piece of a resiliently deformable material is provided between the support and the pushbutton. The intermediate piece and the pushbutton define a measured quantity chamber for the product. The intermediate piece has an opening for communication between the tubular conduit of the support and the measured quantity chamber, and sealingly bears against at least one opening for passage between the measured quantity chamber and the outlet conduit of the pushbutton.

A drawback of this known dispensing device is that the outlet conduit is ending in the upper cap of the pushbutton and therefore not very practicable. In addition since there are two parallel walls in the intermediate piece which have to be stretched if the pushbutton is actuated the resilient resistance is quite high. Another drawback is that the dispensing device might drip after dispensing the product.

In DE 10 2008 029 004 A1 a dispenser is described for dispensing fluid or pasty products with a supply chamber, a head piece, a pump chamber, an inlet valve and an outlet valve, wherein the pump chamber is made as an integral body from a resilient plastic material. The pump chamber body comprises a bottom connection part which is formed as a ring collar. The outlet valve exists of a separate flat piece which is cooperating with the pump chamber body. If the head piece is actuated the pump chamber body is pressed down so that it is bulged. Therefore the volume of the pump chamber is only marginally reduced by the pump chamber body and the pump action is less efficient as with a piston cylinder embodiment.

OBJECT OF THE INVENTION

It is the object of the present invention to provide a pumping device with less parts which have a more simple form and can be manufactured and assembled more easily and preferable in an automatic assembling process.

This object is achieved by a pumping device which comprises a fluid chamber and a piston for reducing the volume of the fluid chamber, comprising an actuator and a head part which is connectable onto the container, wherein the actuator comprises an outlet conduit and a first cylindrical member, and the head part comprises a second cylindrical member which is arranged coaxially to the first cylindrical member, further comprising a folded membrane member provided between the first and second cylindrical members, wherein the folded membrane member has an inlet valve and an outlet valve, such that the first and second cylindrical members and the folded membrane member provide a variable pump chamber. The outlet valve is arranged relative to the actuator in such a manner that a suck-back chamber with a variable volume is provided between the outlet valve and the outlet conduit, whereby such volume is simultaneously reduced as the volume of the pumping chamber is reduced.

The pumping device of the present invention has the large advantage that merely less different parts are necessary, whereas the pumping mechanism is very reliable. Also the irksome dripping of know pumping devices is prevented by the suck-back chamber of the present pumping device.

SUMMARY OF THE INVENTION

In accordance with one aspect of the present invention that the spring function is provided by the membrane part and simultaneously the inlet and outlet valves are integrated by the membrane part.

BRIEF DESCRIPTION OF THE FIGURES

The invention will now be described in greater detail, by way of example, with reference to the accompanying drawings, in which.

DETAILED DESCRIPTION

Figure 1:
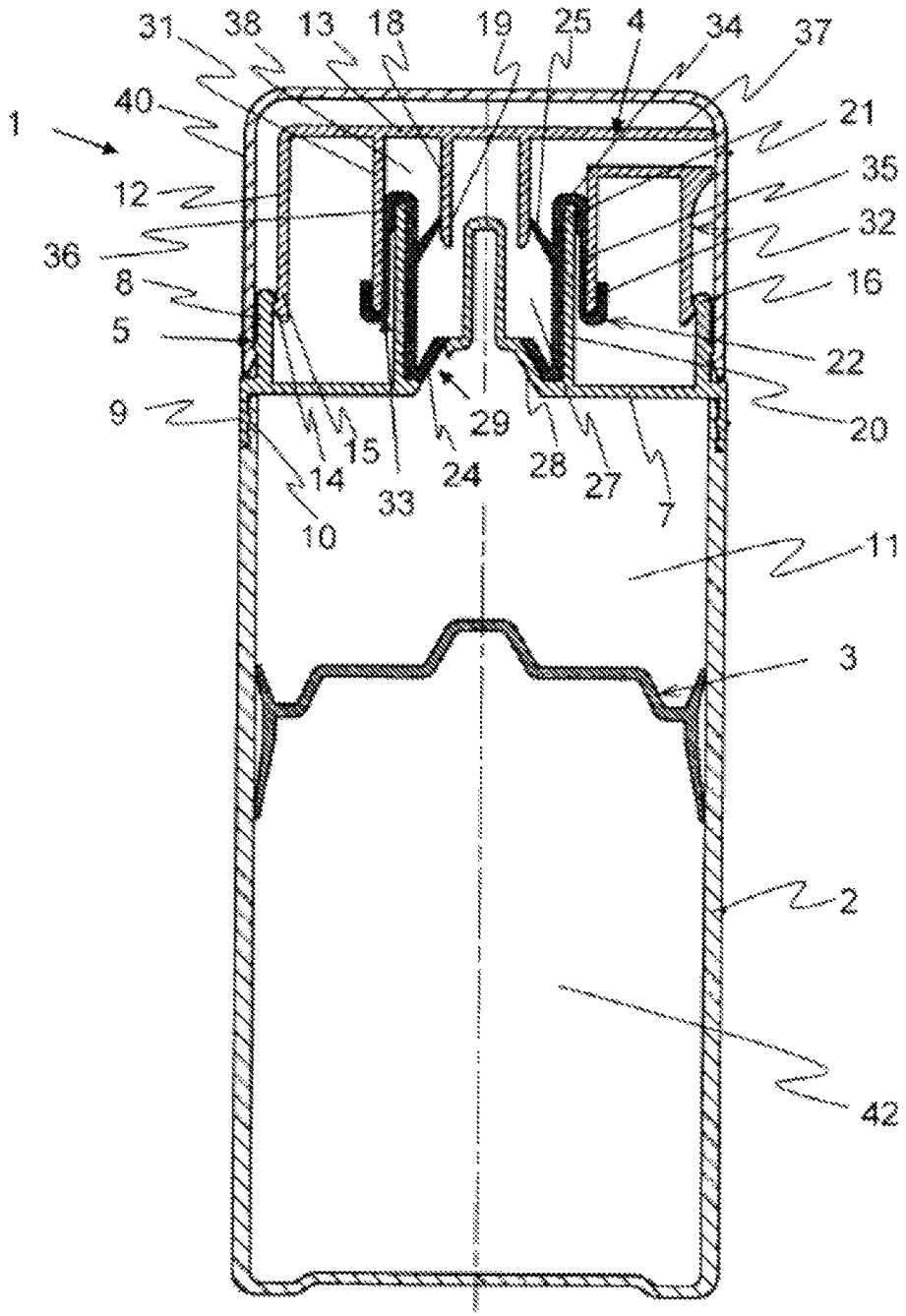
FIG. 1 shows a pumping device connected to a container in the released position.

In FIG. 1 a pumping device 1 is depicted which is screwed on top of a container 2 which has a piston 3 for expelling fluid out of the container 2. The pumping device 1 has an actuator 4 and a head part 5. The head part 5 has a bottom 7 with an outer ring cylinder 8 on top and bottom ring cylinder 9 with an inner screw thread 10 for connecting the head part 5 to the container 2. Between the head part 5 and the piston 3 a fluid chamber 11 is formed in the container 2. The actuator 4 has an outer cylindrical cover 12 with a flat top 13 and is provided at its open end 14 with a ring-shaped outer bulge 15, which cooperates with an inner bulge 16 at the outer ring 8 of the head part 5, so that the actuator 4 is slideably received in the head part 5. The actuator 4 has further at the inside a first cylindrical member 18 with a lower open end 19. A second cylindrical member 20 with an upper open end 21 is mounted on top of the head part 5. The diameter of the first cylindrical member 18 is smaller than the diameter of the second cylindrical member 20, i.e. the first cylindrical member 18 is circumvented by the second cylindrical member 20. Between the first cylindrical member 18 and the second cylindrical member 20 a membrane member 22 with a lower inlet valve 24 and an upper outlet valve 25 is provided, such that a pump chamber 27 is formed. Centrally on the head part 5 a small cone 28 is provided with an opening 29 towards the container 2. The inlet valve 24 provided by a conical lip of the membrane member 22 is resting on the cone 28 and thus closing the opening 29. The outlet valve 25 provided also by a conical lip is resting towards the outer wall of the first cylindrical member 18, so that the outlet valve 25 is also closed. On the small cone 28 a closed tube 30 can be provided for reducing the volume of the pump chamber 27. However, this closed tube 30 is not necessary for the function of the present pumping device 1. For instance in the embodiment of FIGS. 2*a* to 2*e* (see below) there is no closed tube 30, but only the small cone 28 with one or more openings 29.

The actuator 4 has further a third cylindrical member 31 with a lower ring-shaped open end 32 which has a slightly larger diameter than the second cylindrical member 20 and thus providing a clearance 33 between the cylindrical members 20 and 31. The membrane member 22 is folded at the upper edge 34 and has a resilient part 35 which is sealing the clearance 33 and is ending in a lock seam 36, which is gripping the open end 32. The resilient part 35 of the membrane member 22 is formed by a reduced thickness so that the membrane member 22 can be stretched as the actuator 4 is pushed down. Further the third cylindrical member 31 is ending at the upper side of the actuator 4 into a spout or outlet conduit 37.

As can be seen in FIG. 1 between the outlet valve 25 and the spout or outlet conduit 37 there is a chamber 38 which serves as so called suck-back chamber which is preventing dripping of the pumping device 1 after fluid has been dispensed or pressed out. The pumping device 1 connected to the container 2 may be closed by a cap 40. Further an air chamber 42 is provided in the container 2 below the piston 2. A small hole or clearance (not shown) is provided in the lower part of the container 2 under the piston in its lowest position.

The first and third cylindrical members 18 and 31 and the outlet conduit 37 are integrally formed with the actuator 4. Also the outer ring cylinder 8, the second cylindrical member 20 and the closed tube 30 are integrally formed with the head part 5. The membrane member 22 with the inlet valve 24, the outlet valve 25, the resilient part 35 and the lock seam 36 are made in one piece made of a suitable soft plastic material like a thermoplastic elastomer as polyethylene (PE).

The pumping device 1 and the container 2 are manufactured from a suitable hard plastic material like polypropylene (PP) or polycarbonate (PC).

The pumping device 1 with the membrane member 22 can be advantageously manufactured by a two-component blow molding process so that the different parts are readily assembled and no further assembling steps are needed.

Figure 2A:
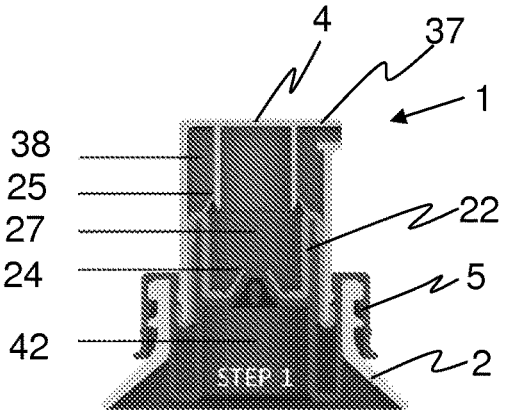
FIG. 2 shows different positions of the pumping device.
Figure 2B:
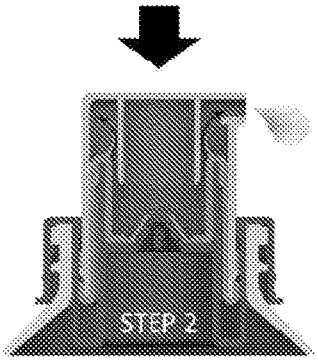
Figure 2C:
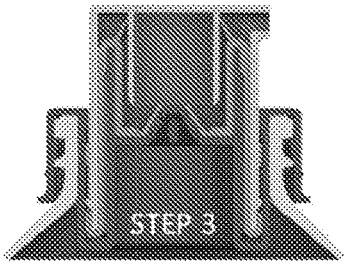
Figure 2D:
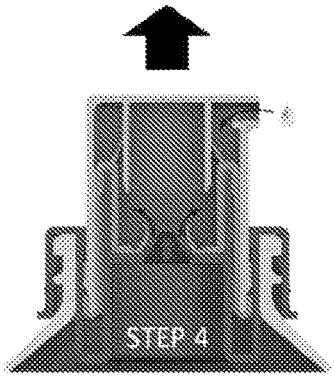
Figure 2E:
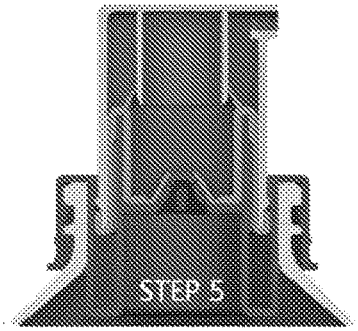
Figure 3:
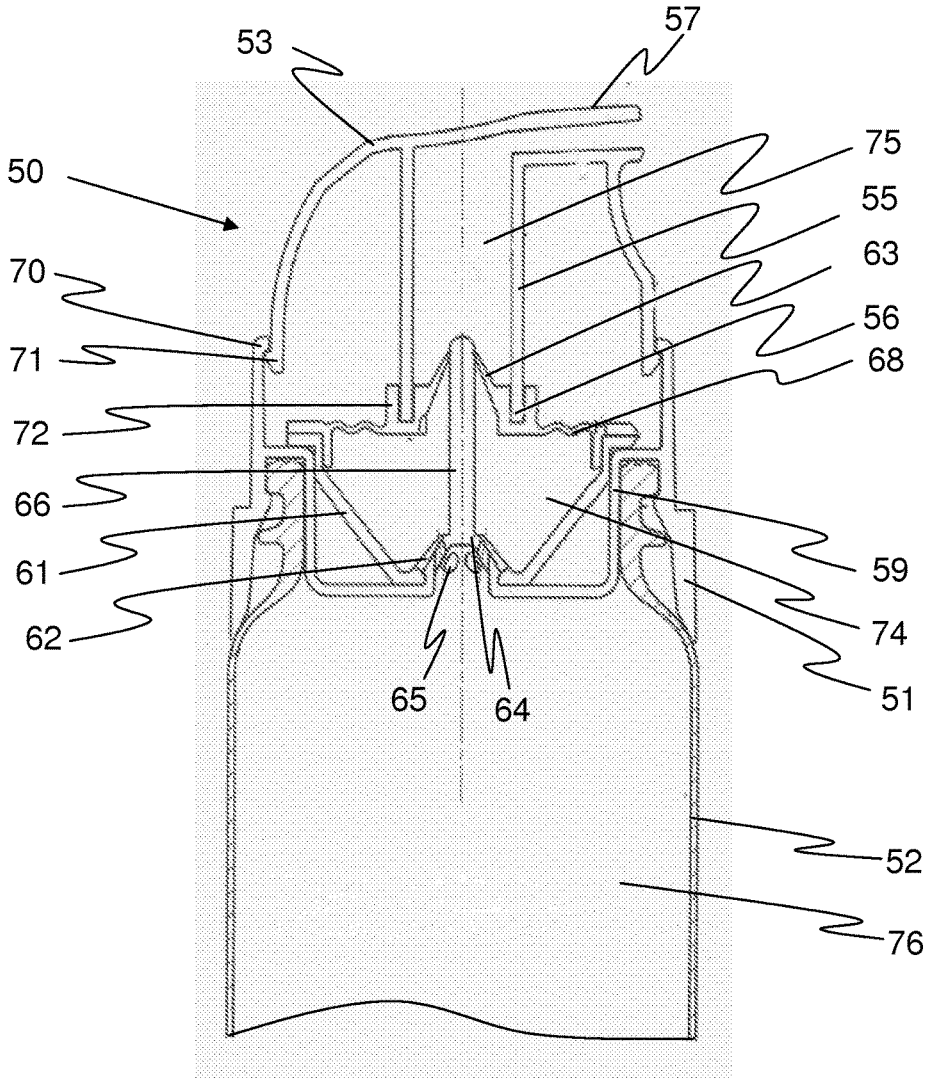
FIG. 3 shows an alternative design of the pumping device.

The function of the pumping device 1 is depicted in FIGS. 2*a* to 2*e* and can be described as follows:

FIG. 2*a* (STEP 1) shows the released position of the pumping device 1, i.e. since the membrane member 22 is made of an elastic material like thermoplastic elastomer the actuator 4 is pushed upwards which position is restricted by the bulges 15 and 16. In this position the inlet valve 24 and the outlet valve 25 are closed. In FIG. 2*b* (STEP 2) the actuator 4 is pushed downwards (indicated by a downward arrow) and the volume of the pump chamber 27 decreases so that the pressure in that chamber rises. Thus the outlet valve 25 will be opened and fluid in the pump chamber 27 will be pushed out through the outlet valve 25 and the spout 37. In FIG. 2*c* (STEP 3) the actuator 4 is completely pushed down and the pressure in the pump chamber 27 will be stabilized to atmospheric pressure and the outlet valve 25 will be closed. If the actuator 4 will be released, as shown in FIG. 2*d* (STEP 4) and indicated by an upward arrow, the volume of the pump chamber 27 will increase and the pressure therein will decrease (underpressure) so that the inlet valve 24 will open and fluid will be sucked from the fluid chamber 11 into the pump chamber 27. As the volume of the suck-back chamber 38 will simultaneously increase, the pressure in this chamber will decrease (underpressure) so that fluid at the outlet of the spout 37 will be sucked back into the suck-back chamber 38. Because of the underpressure in pump chamber 27 there will be a similar underpressure in the fluid contained in the fluid chamber 11, so that the piston 3 is moved upwards until equilibrium of the pressures in the fluid chamber 11 and in the air chamber 42 beneath the piston 3 is reached. Through the small hole or clearance at the bottom part of the container air from the outside is flowing into the air chamber 42 until atmospheric pressure is reached. FIG. 2*e* (STEP 5) is equal to the starting position of FIG. 2*a* in which the inlet valve 24 and the outlet valve 25 are closed and the pressure in the pump chamber 27 and in the suck-back chamber 38 are stabilized.

Figure 4:
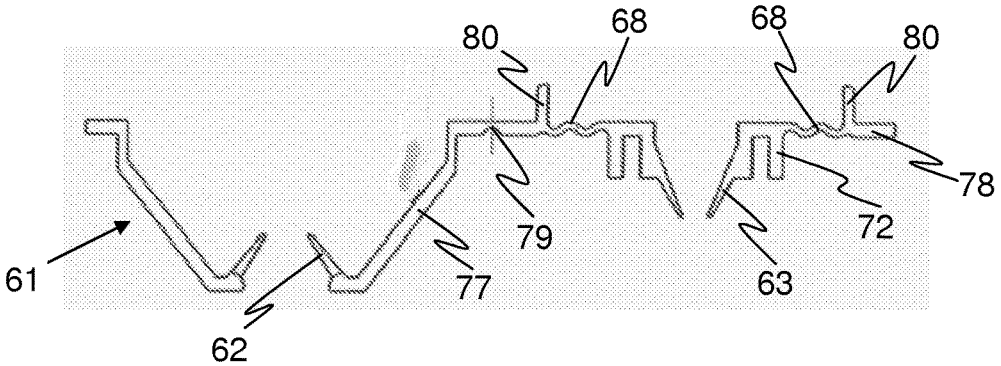
FIG. 4 shows an alternative design of the membrane member.

In FIG. 4 a cross-section of a second embodiment 50 of the pumping device according to the present invention is depicted. The pumping device 50 has a head part 51, which been mounted to a container 52 by a snap-on connection, and an actuator 53 which is slideably mounted in the head part 51. The actuator 53 has a first cylindrical member 55 with a lower open end 56 and a spout of outlet conduit 57. As can be seen in FIG. 4 the top part 58 of the actuator 53 is curved towards the spout 57. The head part 51 has a second cylindrical member 59 with a larger diameter than the first cylindrical member 55 and in between both members 55 and 59 a membrane member 61 is provided. The membrane member 61 has a lower inlet valve 62 and an upper outlet valve 63, both made of conical lips integrally formed to the membrane member 61. The head part 51 has further a central small cone 64 which has several openings 65 which are closed by the inlet valve 62 in rest position of the pumping device 50. On the small cone 62 a pin 66 is provided which bears the conical lip of the outlet valve 63.

The membrane member 61 has further a resilient part 68 which is provided by corrugations so that the actuator 53 is urged in the upper position in which the actuator 53 and the head part 51 are restricted by the bulges 70 and 71 as in the first embodiment. The membrane member 61 has a ring-shaped lock seam 72 surrounding the outlet valve 63 which is gripping the open end of the first cylindrical member 55.

In this second embodiment 50 the membrane member 61 as such forms a pump chamber 74 which can be reduced by pushing the actuator 53 by which action the first cylindrical member 55 is pushed against the lock seam 72 and pushes down the outlet valve 63 over the pin 66. The chamber 75 within the first cylindrical member 55 above the outlet valve 63 is here also a suck-back chamber which is reduced simultaneously with pump chamber 74 by the pushing action of the actuator 53. The container 52 forms a fluid chamber 76 which is arranged above a—here not shown—piston as in the first embodiment of FIG. 1.

In FIG. 5 the membrane member 61 is shown in cross-section. A lower part 77 has a frusto-conical shape and an upper part 78 has a flat shape with the corrugations 68 of the resilient part. The lower part 77 and the upper part 78 are connected by a bridge 79 of smaller thickness, so that the upper part 78 can be folded onto the lower part 77. Two small cams 80 are provided on both sides of the corrugations 68 so that the upper part 78 can be properly aligned to the lower part 77.

The function of the second embodiment of the pumping device 50 is similar as described with respect to FIGS. 2*a* to 2*e*. For manufacturing of the pumping device 50 the same plastic materials and the same production process are used as for the first embodiment 1.

The invention claimed is:

1. A pumping device for dispensing a fluid, comprising:
a container;
a fluid chamber;
an actuator and a head part which is connected onto the container, the actuator being movable in a down stroke pumping movement towards the container and in an upstroke movement away from the container, wherein the actuator comprises an outlet conduit and a first cylindrical member, and wherein the head part comprises a second cylindrical member which is arranged coaxially to the first cylindrical member;
a piston in the container for reducing the volume of the fluid chamber, wherein the fluid chamber is formed between the piston and the head part; and
a folded membrane member provided between the first and second cylindrical members,
wherein the folded membrane member has an inlet valve and an outlet valve, such that the first and second cylindrical members and the folded membrane member provide a variable pumping chamber,
wherein the inlet valve is sealing on a central upwardly protrusion of the head part and the outlet valve is sealing and slideably arranged relative to the actuator or sealing and slideably arranged relative to the head part during the pumping movement, such that the outlet valve and a contact location of the outlet valve with the actuator is moved along the actuator synchronously with the pumping movement of the actuator back and forth towards and away from the head part or the outlet valve and a contact location of the outlet valve with the head part is moved along the head part synchronously with the pumping movement of the actuator back and forth towards and away from the head part,
whereas the outlet valve is closed and in sliding contact with the actuator throughout an upstroke of the pumping movement or the outlet valve is closed and in sliding contact with the head part throughout the upstroke of the pumping movement, and in such a manner that a suck-back chamber with a variable volume is provided between the outlet valve and the outlet conduit and remains open to an exterior of the pumping device throughout the pumping movement, which variable volume is synchronously reduced and increased as the volume of the pumping chamber is reduced and increased by said pumping movement, and
wherein the folded membrane member comprises a resilient part which is provided between the actuator and the head part and which urges the actuator in a rest position relative to the head part.

2. The pumping device according to claim 1, wherein the inlet valve and the outlet valve are arranged at a predetermined invariable distance to another relative to the folded membrane.

3. The pumping device according to claim 2, wherein the resilient part is connected between the actuator and the head part.

4. The pumping device according to claim 1 wherein the inlet valve and the outlet valve are formed as tapered lips.

5. The pumping device according to claim 1 wherein the actuator comprises a third cylindrical member which coaxially circumvents the second cylindrical member of the head part to form the suck-back chamber between the outlet valve and the outlet conduit.

6. The pumping device according to claim 5, wherein the folded membrane member has at its open end a lock seam which grips the open end of the third cylindrical member.

7. The pumping device according to claim 1, wherein the folded membrane member forms the pump chamber and the outlet valve of the folded membrane member is fixedly mounted to the first cylindrical member of the actuator.

8. The pumping device according to claim 7, wherein the folded membrane member has a conical lower part towards the inlet valve and a closed upper part towards the outlet valve, wherein the closed upper part comprises said resilient part for urging the actuator into the rest position.

9. The pumping device according to claim 8, wherein the resilient part has a corrugated shape.

10. The pumping device according to claim 1, wherein the actuator and the head part are made from a hard plastic material.

11. The pumping device according to claim 1, wherein the folded membrane member is made from an elastomeric plastic material.

12. The pumping device according to claim 11, wherein the material is a thermoplastic elastomer.

13. A pumping device for dispensing a fluid, comprising:
a container having a fluid chamber;
an actuator coupled to the container and including an outlet conduit and a first cylindrical member, the actuator being movable in a down stroke pumping movement towards the container and in an upstroke movement away from the container;
a head part which is connected onto the container, the head part including a second cylindrical member which is arranged coaxially to the first cylindrical member of the actuator;
a piston in the container for reducing a volume of the fluid chamber during operation, wherein the fluid chamber is formed between the piston and the head part; and
a membrane member provided between the first cylindrical member of the actuator and the second cylindrical member of the head part, the membrane member providing an inlet valve and an outlet valve,
wherein the first cylindrical member of the actuator, the second cylindrical member of the head part and the membrane member define a variable pumping chamber,
wherein the inlet valve is sealing on a central upwardly protrusion of the head part and the outlet valve is sealing and slideably arranged relative to the actuator or sealing and slideably arranged relative to the head part during the pumping movement, such that the outlet valve and a contact location of the outlet valve with the actuator is moved along the actuator synchronously with the pumping movement of the actuator back and forth towards and away from the head part or the outlet valve and a contact location of the outlet valve with the head part is moved along the head part synchronously with the pumping movement of the actuator back and forth towards and away from the head part, whereas the outlet valve is closed and in sliding contact with the actuator throughout an upstroke of the pumping movement or the outlet valve is closed and in sliding contact with the head part throughout the upstroke of the pumping movement, and in such a manner that a suck-back chamber with a variable volume is provided between the outlet valve and the outlet conduit and remains open to an exterior of the pumping device throughout the pumping movement, which variable volume is synchronously reduced and increased as the volume of the pumping chamber is reduced and increased by said pumping movement, and wherein the membrane member comprises a resilient part which is provided between the actuator and the head part and which urges the actuator in a rest position relative to the head part.

* * * * *